US006681660B2

(12) United States Patent
Foard

(10) Patent No.: US 6,681,660 B2
(45) Date of Patent: Jan. 27, 2004

(54) VARIABLE SPEED RATCHET WRENCH AND METHOD OF USE

(76) Inventor: William Andrew Foard, 18312 Gunpowder Rd., Hampstead, MD (US) 21074

( * ) Notice: Subject to any disclaimer, the term of this patent is extended or adjusted under 35 U.S.C. 154(b) by 22 days.

(21) Appl. No.: 10/109,673

(22) Filed: Apr. 1, 2002

(65) Prior Publication Data

US 2002/0152847 A1 Oct. 24, 2002

Related U.S. Application Data

(60) Provisional application No. 60/281,027, filed on Apr. 4, 2001.

(51) Int. Cl.[7] ..... B25B 17/00

(52) U.S. Cl. ..... 81/57.31; 81/57.3; 81/58.1

(58) Field of Search ..... 81/57, 57.14, 57.22, 81/57.3, 57.31, 57.32, 58.1

(56) References Cited

U.S. PATENT DOCUMENTS 1,762,515 A 6/1930 Hiersch
2,520,443 A * 8/1950 Seaquist ..... 81/57.31
2,558,897 A * 7/1951 Akins ..... 81/57.31
2,634,630 A 4/1953 Johnson
2,641,136 A * 6/1953 Marsden, Jr. et al. ..... 81/57.31
3,828,629 A * 8/1974 Moore ..... 81/57.3
3,945,274 A 3/1976 Annett, II
3,983,759 A * 10/1976 Linden ..... 81/57.3
4,546,676 A * 10/1985 Kiefer, Jr. ..... 81/58.1
5,775,182 A * 7/1998 Plakinger ..... 81/57.3

* cited by examiner

*Primary Examiner*—D. S. Meislin
(74) *Attorney, Agent, or Firm*—Arent Fox Kintner Plotkin & Kahn, PLLC; Wilburn L. Chesser

(57) ABSTRACT

A variable speed ratchet wrench comprising a main handle portion with an opening for receiving a planetary gear mechanism, a planetary gear mechanism with a locking device attached to an output shaft for driving wrench fittings, and a planetary gear housing cover. The planetary gear housing cover comprises an attached secondary handle that allows the planetary gears to revolve relative to the sun gear in a non-locked position and prevents the planetary gears from revolving about the sun gear when locked in a locked position, thereby providing a geared speed increase in the driven speed of the output shaft. The planetary gear mechanism includes a sun gear, a first and second planetary gear, and an inner ring gear for driving the output shaft.

16 Claims, 8 Drawing Sheets

VARIABLE SPEED RATCHET WRENCH AND METHOD OF USE

This application claims priority from U.S. Provisional Application Serial No. 60/281,027 filed Apr. 4, 2001. The entirety of that provisional application is incorporated herein by reference.

BACKGROUND OF THE INVENTION

1. Field of the Invention

The present invention relates to a variable speed ratchet wrench, and in particular to a variable speed ratchet wrench using a planetary gear arrangement.

2. Background of the Technology

Speed wrenches with planetary gear arrangements are known in the prior art. However, the wrenches of the prior art are difficult to operate. In addition, they include complex mechanical components, which make the wrench difficult and more expensive to operate, construct, maintain and repair.

3. Description of Related Art

U.S. Pat. No. 1,762,515 to Hiersch discloses a speed wrench. To get a one-to-one geared speed, the operator presses downwardly on the operating handle. To get enhanced geared speed, the downward pressure is released on the handle and the speed changing device is restored to its normal position.

U.S. Pat. No. 2,520,443 to Seaguist discloses a planetary gear speed wrench. To get a one-to-one geared speed, the wrench is inverted and the operator holds a first handle and rotates a second handle. To get enhanced geared speed: the second handle is held stationary by the operator, and the first handle is revolved; the first handle is held stationary and the second handle is revolved, or both the first handle and the second handle may be rotated simultaneously relative to one another in opposite directions.

U.S. Pat. No. 2,634,630 to Johnson discloses a geared wrench that can be used as a multiple rotational advantage ratchet type of wrench for both loosening and tightening operations. To use the assembly as a multiple rotational wrench for a tightening operation, the handle is grasped in the operator's hand. The auxiliary handle is then grasped in the operator's other hand. The auxiliary handle is then reciprocated while the handle is held stationary. The operator can hold the auxiliary handle stationary and reciprocate the wrench handle with his other hand, and thereby achieve the same results. To use the assembly as a one-to-one wrench without the ratchet action, the wrench handle and the auxiliary handle are rotated together.

U.S. Pat. No. 3,945,274 to Annett discloses a speed wrench where, if the hand grip is held against rotation by the operator while the handle is turned, the output will be driven at a speed greater than that of the handle. If the resistance offered by the driven object becomes large enough so that the hand grip may not conveniently be held, the operator may release the hand grip or slacken his hold thereof thus allowing the ratchet to engage and lock the handle to the output so that the handle will directly drive the output.

There is a present need for a simpler variable speed ratchet wrench.

SUMMARY OF THE INVENTION

The present invention provides a variable speed ratchet wrench that is simpler than the prior art, and functions logically based on existing standard ratchet wrench operation. The fact that the present invention is simpler has many benefits over the prior art, including, but not limited to: easier manufacture, less-costly manufacture, easier operation, easier maintenance, and easier repair.

An embodiment of the present invention comprises a variable speed ratchet wrench having: a main handle portion with an opening for receiving a planetary gear mechanism, a planetary gear mechanism with a locking device attached to the output shaft for driving wrench fittings, and a planetary gear housing cover having an attached secondary handle that controls operation via the planetary gears. The locking device has two positions, such that ratching action is achievable for both clockwise and counterclockwise driving. The secondary handle selectively revolves the planetary gears relative to the sun gear in an unlocked position and prevents the planetary gears from revolving about the sun gear in a locked position, thereby selectively providing a geared speed increase in the driven speed of the output shaft.

In an embodiment of the present invention, the planetary gear mechanism includes a sun gear, two interconnected planetary gears, and a ring gear for driving the output shaft, such that the direction of motion of the handle and ring gear match the direction of motion of the output shaft. The sun gear is intermeshed with the first planetary gear, the first planetary gear is intermeshed with the second planetary gear, and the second planetary gear is intermeshed with inner teeth of the ring gear, such that rotational motion of the sun gear is in the same direction as the ring gear, in contrast to speed wrenches of the prior art. This feature allows use of the ratchet in a manner similar to typical non-speed ratchet wrenches.

To get a one-to-one drive with a ratchet function in an embodiment of the present invention, the secondary handle is locked into position against the main handle, thereby locking the planetary gears to prevent revolution about the sun gear. To obtain a geared speed enhancement with a ratchet function, the operator releases the secondary handle from the main handle, and the relative motion of the main and secondary handles allows the planetary gears to revolve about the sun gear.

Additional advantages and novel features of the invention will be set forth in part in the description that follows, and in part will become more apparent to those skilled in the art upon examination of the following or upon learning by practice of the invention.

DETAILED DESCRIPTION

The present invention provides a variable speed ratchet wrench that is simpler in use and construction than the prior art. An embodiment of the present invention comprises a variable speed ratchet wrench having: a main handle portion with an opening for receiving a planetary gear mechanism, a planetary gear mechanism with a locking device attached to the output shaft for driving wrench fittings, and a planetary gear housing cover having an attached secondary handle that controls operation via the planetary gears. To obtain a one-to-one drive with a ratchet function, the secondary handle is locked into position against the main handle, thereby locking the planetary gears to prevent revolution about the sun gear. To obtain a geared speed enhancement with a ratchet function, the operator releases the secondary handle from the main handle, and the relative motion of the main and secondary handles allows the planetary gears to revolve about the sun gear.

References will now be made in detail to embodiments of the present invention, examples of which are illustrated in the accompanying drawings.

Figure 1:
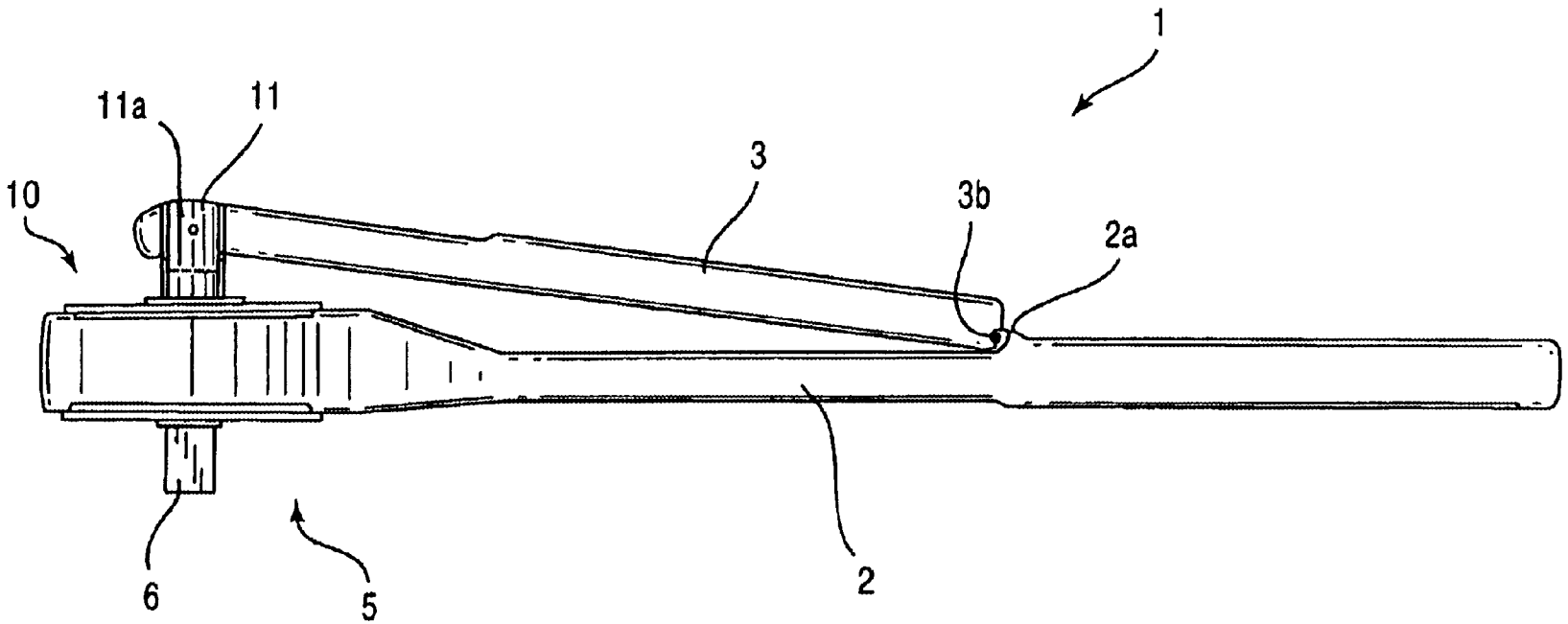
FIG. 1 is a perspective view of a variable speed ratchet wrench, in accordance with an embodiment of the present invention.

FIG. 1 presents a perspective view of a variable speed ratchet wrench in accordance with an embodiment of the present invention. As shown in FIG. 1, the wrench 1 includes a main handle 2 and a secondary handle 3. The main handle includes a larger driven end 5 for driving an output shaft 6. The secondary handle 3 is connected to a planetary gear housing cover 10 via an extension 11 to the cover 10. The secondary handle 3 is pivotally coupled to the extension 11, such as via a pin extending through opening 11*a* in extension 11. The secondary handle 3 includes a ball or pin 3*b*, which is biased to extend, at the end opposite of the secondary handle 3 from the attachment point to the extension 11. The biased ball or pin 3*b* in the position shown in FIG. 1, extends into a detent 2*a* in the main handle 2, thereby partially fixing the handle relative to the main handle 2. In an embodiment of the present invention, the secondary handle 3, in the position shown in FIG. 1, also fits within a secondary handle opening in the main handle 2 having approximately the same width as the width of the secondary handle 3, such that the secondary handle 3 is also partially fixably held in the secondary handle opening in the main handle 2 when placed in the position shown in FIG. 1. The secondary handle opening in the main handle 2 and the detent 2*a*, which is located within the secondary handle opening in the main handle 2, thereby together fix the secondary handle 3 relative to the main handle 3 when positioned as shown in FIG. 1.

Figure 2:
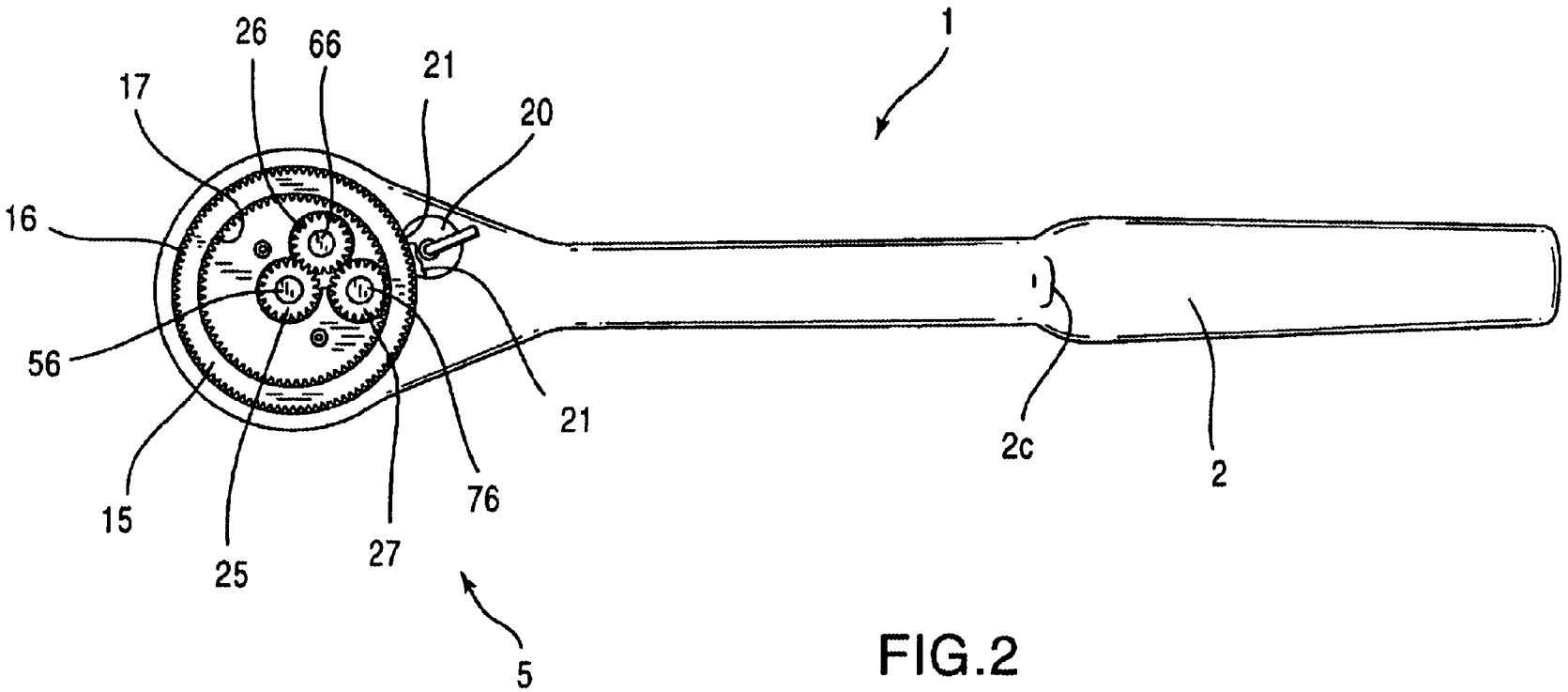
FIG. 2 is an overhead view of the variable speed ratchet wrench, with the planetary gear housing cover removed to expose the planetary gear mechanism, in accordance with an embodiment of the present invention.

FIG. 2 provides an overhead view of the variable speed ratchet wrench of FIG. 1, with the planetary gear housing cover removed to expose the planetary gear mechanism. As shown in FIG. 2, the main handle 2 includes a large end 5 for housing the planetary gear mechanism and the secondary handle opening 2*c* for partially fixably holding the secondary handle 3 relative to the main handle 2. The planetary gear mechanism includes a ring gear 15 having teeth on the outer portion 16 of the ring gear 15, the teeth on the outer portion 16 extending the full width of the ring gear 15. The ring gear 15 also has teeth on its inner surface 17 partially or fully extending the width of the ring gear 15. The handle 2 also includes a ratchet locking device 20, which is positionable in two positions, such that a ratcheting drive is achievable with the wrench 1. The locking device 20 is biasedly positionable such that the outer teeth 16 of the ring gear 15 are able to pass in only one direction past teeth 21 on the locking device 20. The locking device 20 has two positions, such that ratching action is achievable for both clockwise and counterclockwise driving. The planetary gear mechanism includes a sun gear 25 and two intermeshing planetary gears 26, 27. The sun gear 25 is intermeshed with the first planetary gear 26, the first planetary gear 26 is intermeshed with the second planetary gear 27, and the second planetary gear is intermeshed with the inner teeth 17 of the ring gear 15, such that rotational motion of the sun gear 25 is in the same direction as the ring gear 15, in contrast to speed wrenches of the prior art. This feature allows use of a simpler ratchet locking device 20 and allows the use of the ratchet in a manner similar to typical non-speed ratchet wrenches.

Figure 3A:
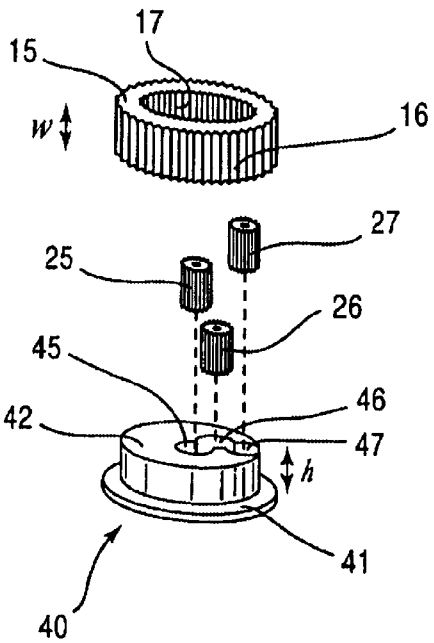
FIGS. 3A–3C show exploded views of the components of the planetary gear mechanism in accordance with an embodiment of the present invention.
Figure 3B:
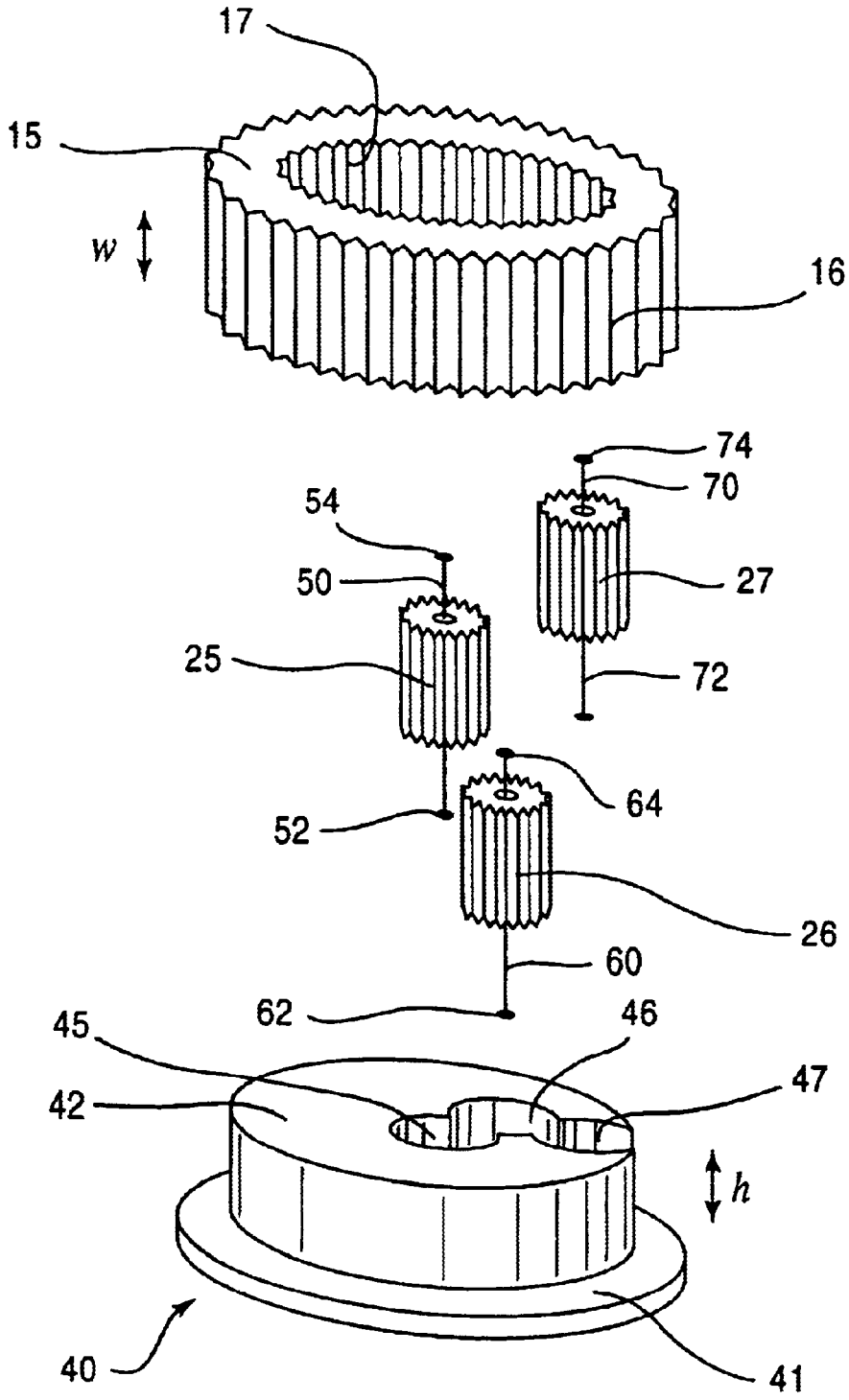
Figure 3C:
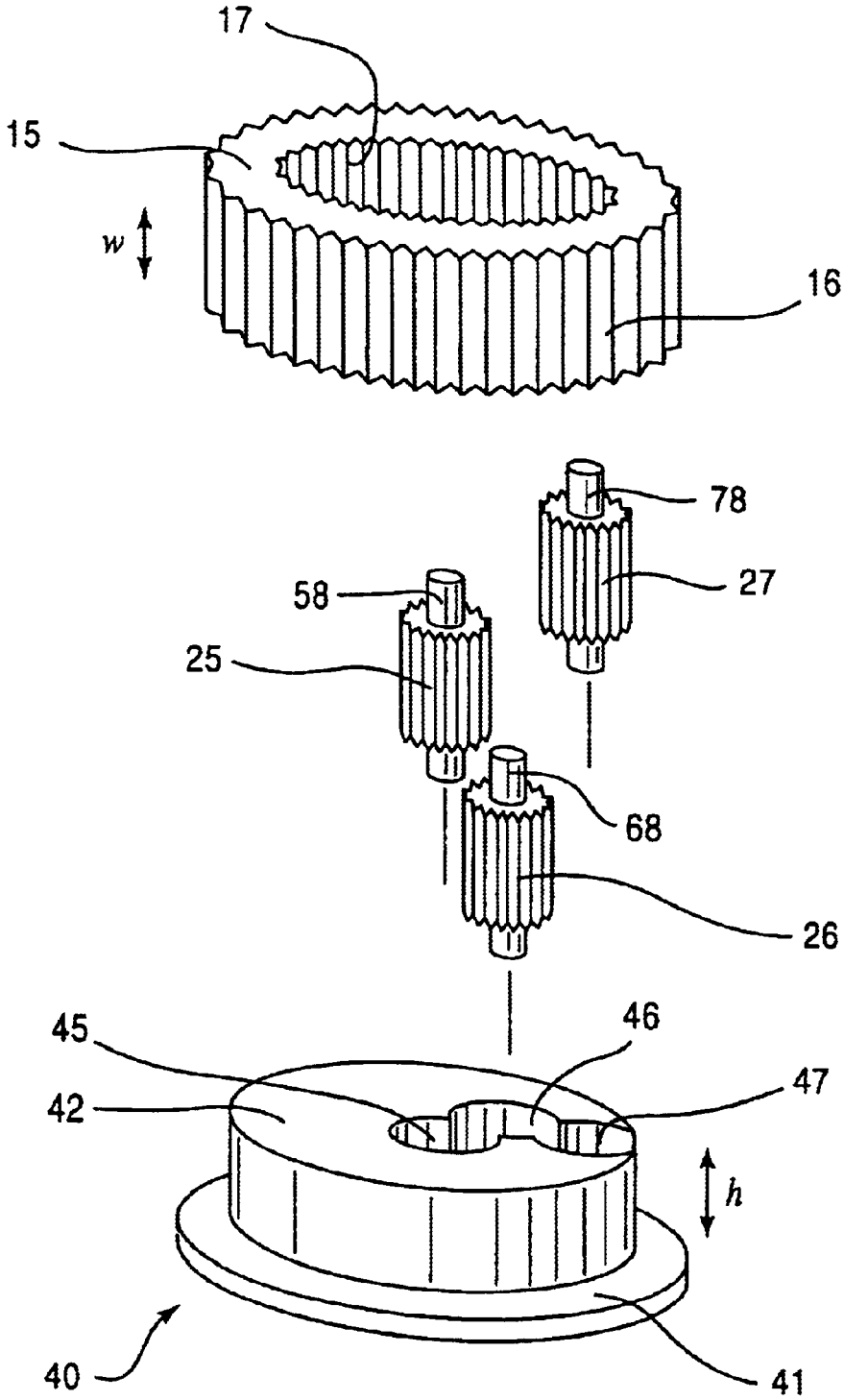

FIGS. 3A–3C show an exploded view of the components of the planetary gear mechanism in accordance with an embodiment of the present invention. As shown in FIG. 3A, the planetary gear mechanism components include the ring gear 15, having teeth on its outer surface 16 extending the width w of the ring gear 15. The ring gear 15 also has teeth on its inner surface 17, the inner surface teeth extending either fully or only partially the width w of the ring gear 15.

In one embodiment, in which the inner surface teeth extend only partially the width w of the ring gear 15, the inner surface teeth extend from the bottom surface of the ring gear 15, as viewed in FIGS. 3A–3C, to a height h. As further shown in FIGS. 3A–3C, a planetary gear housing bottom 40 includes an outer lip 41 and an inner extension 42 extending height h. The inner extension 42 includes recessed portions 45, 46, 47 for receiving the sun gear 25 and planetary gears 26, 27, respectively.

In one embodiment, in which the inner surface teeth extend only partially the width w of the ring gear 15, the inner surface teeth extend from the bottom surface of the ring gear 15, as viewed in FIGS. 3A–3C, to a height h. As further shown in FIGS. 3A–3C, a planetary gear housing bottom 40 includes an outer lip 41 and an inner extension 42 extending height h. The inner extension 42 includes recessed portions 45, 46, 47 for receiving the sun gear 25 and planetary gears 26, 27, respectively. In one embodiment, each of the sun gear 25 and planetary gears 26, 27 rotate about pins 50, 60 and 70, which extend from both ends of each of the sun gear 25 and planetary gears 26, 27, respectively. See FIG. 3B. These pins fit within corresponding pin receiving openings in the planetary gear housing bottom 40 and the planetary gear housing cover 10. The sun gear 25 further comprises an opening 56 for slidably receiving the sun gear pin 50, the sun gear pin 50 having a first end 52 and a second end 54, the first end of the sun gear pin 50 being fittable into the sun gear pin receiving opening 56 in the planetary gear housing bottom 40. The first planetary gear 26 further comprises an opening 66 for slidably receiving the first planetary gear pin 60, the first planetary gear pin 60 having a first end 62 and a second end 64, the first end of the first planetary gear pin 60 being fittable into a first planetary gear pin receiving opening 66 in the planetary gear housing bottom 40. The second planetary gear 27 further comprises an opening 76 for slidably receiving the second planetary gear pin 70, the second planetary gear pin 70 having a first end 72 and a second end 74, the first end of the second planetary gear pin being fittable into a second planetary gear pin receiving opening 76 in the planetary gear housing bottom 40. The planetary gear housing cover 10 further comprises pin receiving openings. The sun gear pin 54, the first planetary gear pin 64, and the second planetary gear pin 74 second ends are each fittable into the pin receiving openings of the planetary gear housing cover 10.

Figure 5:
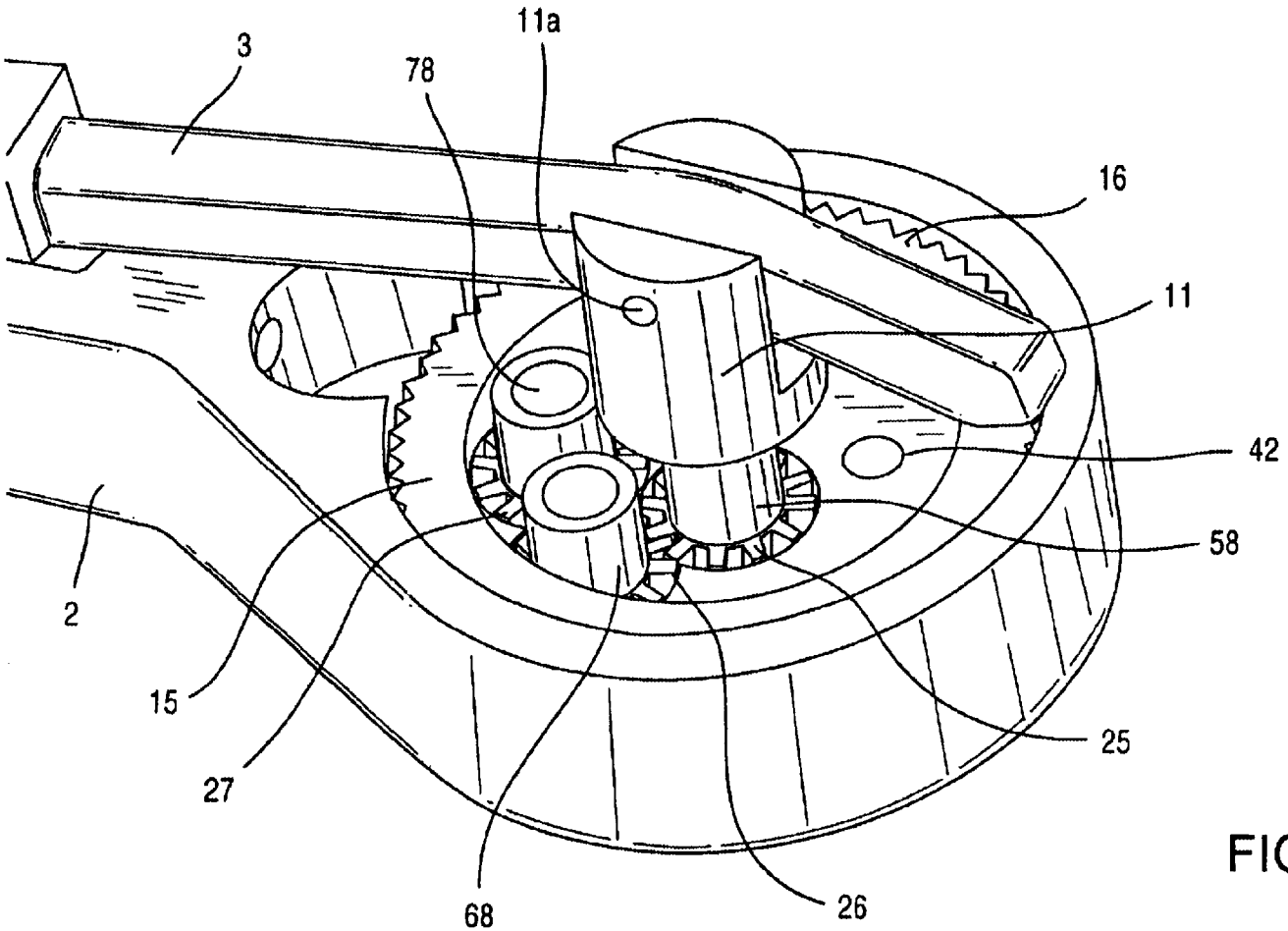
FIG. 5 is an overhead perspective cutaway view of the planetary gear mechanism of the wrench, in accordance with an embodiment of the present invention.

In another embodiment, shown in FIG. 3C and FIG. 5, the sun gear 25 has an axis, an axial length, a first axial end, a second axial end, sun gear teeth that extend radially about the axis partially the axial length at the first axial end, and a sun gear shaft portion 58 that extends along the axis at the second axial end. Similarly, the first planetary gear 26 has an axis, an axial length, a first axial end, a second axial end, and first planetary gear teeth that extend radially about the axis partially the axial length at the first axial end, with a first planetary gear shaft portion 68 extending along the axis at the second axial end. The second planetary gear 27 also has an axis, an axial length, a first axial end, a second axial end, and second planetary gear teeth, which extend radially about the axis partially the axial length at the first axial end, with a second planetary gear shaft portion 78 extending along the axis at the second axial end. In this embodiment, the planetary gear housing cover 10 includes openings for receiving the sun gear shaft portion 58, the first planetary gear shaft portion 68, and the second planetary gear shaft portion 78. Pins extending through each of the sun gear 25 and the first and second planetary gears 26, 27 are optionally usable with this embodiment.

Upon assembly, the inner extension 42 is received within the toothed inner lower portion of the ring gear 15, as viewed in FIG. 3. The teeth on the inner portion of the ring gear 15 thus have a width h or w, such that the ring gear revolves about extension 42, and sun gear 25 is interconnected with ring gear 15 via the two planetary gears 26, 27, each of the sun gear 25 and planetary gears 26, 27 being received within recessed portions 45, 46, 47.

Figure 4:
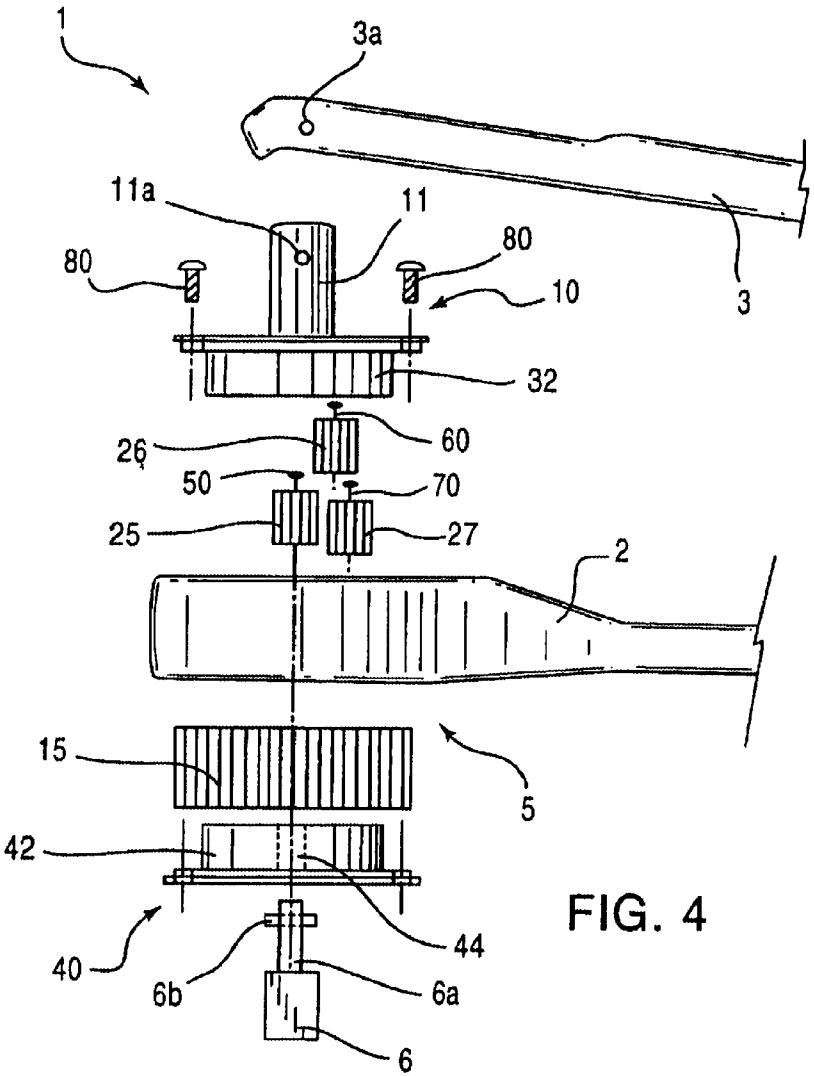
FIG. 4 is an exploded view of the variable speed ratchet wrench, in accordance with an embodiment of the present invention.

FIG. 4 is an exploded view of the wrench of FIG. 1. As shown in FIG. 4, the wrench 1 includes a main handle 2 with a large end 5 for housing the planetary gear mechanism, a secondary handle 3, which is coupleable to the extension 11 of the planetary gear housing cover 10, which has inner extension 32 is one embodiment. The secondary handle 3 is pivotally coupled to the extension 11, via, for example, a pin extending through openings 3*a*, 11*a*. Components of the planetary gear mechanism include the sun gear 25, two planetary gears 26, 27, and the ring gear 15. The wrench 1 also includes the output shaft 6, which is attachable to the wrench 1 via an output shaft extension 6*a* and fixing mechanism 6*b*, such as a pin.

For assembly of the output shaft 6 to the wrench 1, the extension 6*a* is inserted into opening 44 in the planetary gear housing bottom 40 and further into a recess in the sun gear 25, upon the sun gear being inserted into recessed portion 45 in extension 42 of planetary gear housing bottom 40. The fixing mechanism 6*b* then fixably holds the output shaft 6 to the wrench 1 via sandwiching the planetary gear housing bottom 40 between the output shaft 6 and the sun gear 25. The ring gear 15 fits over the extension 42 in the planetary gear housing bottom 40, and the planetary gears 26, 27 fit into the recessed portions 46, 47 in extension 42 of planetary gear housing bottom 40 and, in one embodiment, are able to rotate about shafts extending into openings in the planetary gear housing bottom 40. Other embodiments include use of an extension from each of the sun gear 25 and planetary gears 26, 27, as are clearly shown in FIG. 5, into openings in the planetary gear housing cover 10. Other devices and methods for rotatably fixing the sun gear 25 and planetary gears 26, 27 relative to the planetary gear housing bottom 40 and cover 10 are well known in the art. The planetary gear housing cover 10 is then fittably attached to the wrench 1 over the planetary gear mechanism, with the shafts, in one embodiment, extending from the planetary gears 26, 27 into openings in the planetary gear housing cover 10. In an embodiment of the present invention, a screw 80 or other attaching mechanism inserted, for example, through an opening in the planetary gear housing cover 10, couples the planetary gear housing cover 10 to the planetary gear housing bottom 40, via, for example, a threaded opening in the planetary gear housing bottom 40. The secondary handle 3 is then attached to the extension 11 to the planetary gear housing cover 10 via openings 11*a*, 3*a* and, for example, a pin.

Upon assembly, in operation, fixing of the secondary handle 3 to the main handle 2 fixably holds the planetary gear cover 10 and the planetary gear bottom 40 relative to the handle 2. Extension 6 is then drivable via driving of the ring gear 15 by the ratchet locking device 20, in turn driving the interlocking planetary gears 27, 26 and the interlocking sun gear 25, which is directly attached to the extension 6. In this locked driving arrangement, planetary gears 26, 27 are unable to travel about the sun gear 25 within the ring gear 15 during driving of extension 6. Upon release of the secondary handle 3 from fixing to the main handle 2, planetary gears 26, 27 are able to travel about the sun gear 25 within the ring gear 15, while the ring gear 15 is driven by the ratchet locking device 20. The combined traveling of the planetary gears 26, 27 and motion of the ring gear 15 produces a speed driving of extension 6, relative to a locked driving arrangement. Relative speed is variable depending on selected gear sizes.

FIG. 5 is an overhead perspective cutaway view of the planetary gear mechanism of the wrench, in accordance with an embodiment of the present invention.

Figure 6:
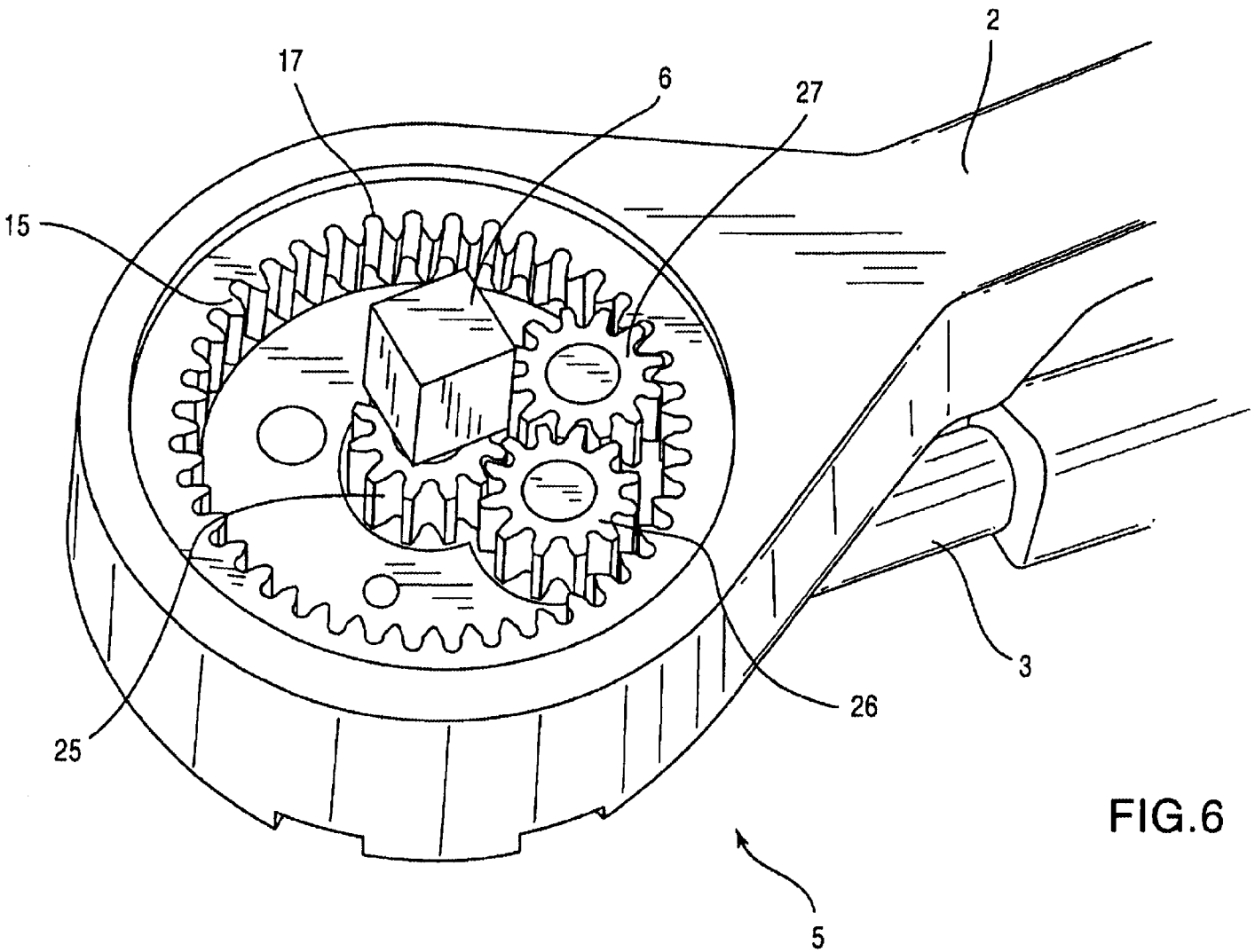
FIG. 6 is an underside perspective cutaway view of the planetary gear mechanism of the wrench, in accordance with an embodiment of the present invention.
Figure 7:
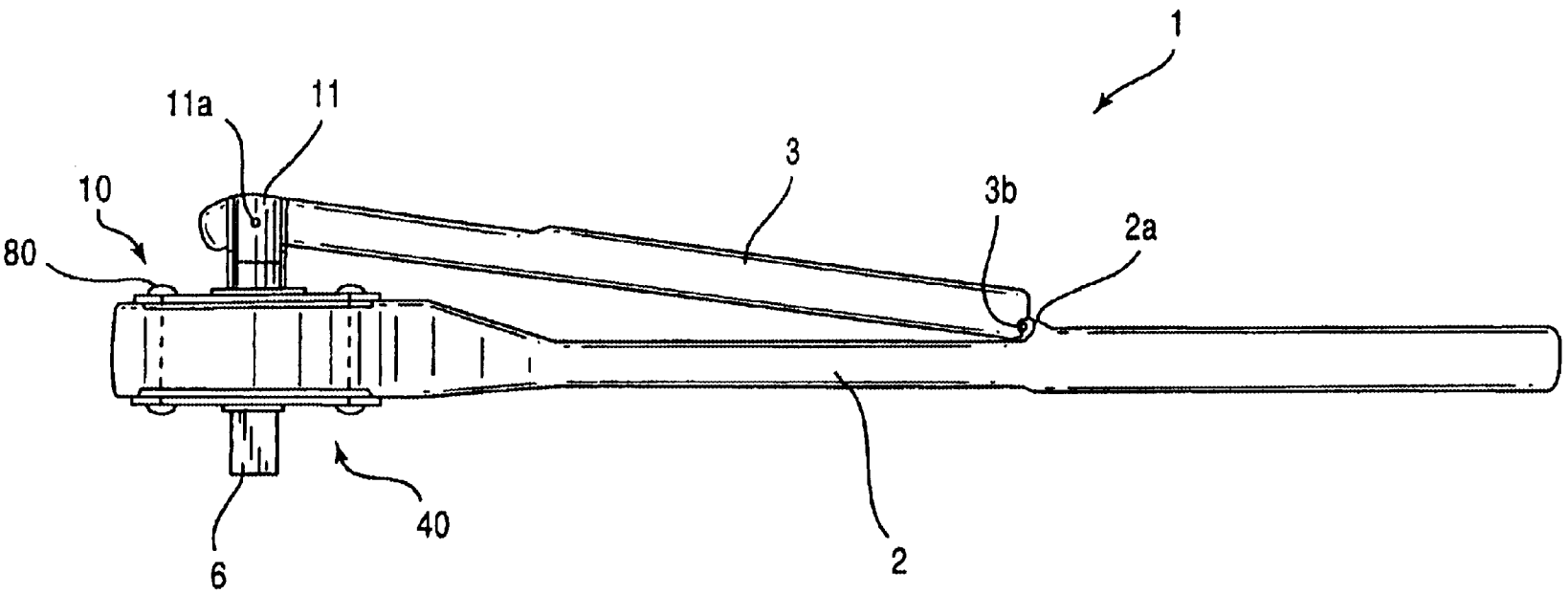
FIG. 7 shows the planetary gear housing being fixedly attached to the gear housing bottom.

FIG. 6 is an underside perspective cutaway view of the planetary gear mechanism of the wrench, in accordance with an embodiment of the present invention.

Example embodiments of the present invention have now been described in accordance with the above advantages. It will be appreciated that these examples are merely illustrative of the invention. Many variations and modifications will be apparent to those skilled in the art.

What is claimed is:

1. A variable speed wrench, comprising:

a main body having a large end with an opening and a main handle portion opposite the large end, the main handle portion including a secondary handle securing mechanism;

a planetary gear mechanism housed in the opening in the main body, the planetary gear mechanism including:

an outer ring gear having an inner circumferential surface about an inner opening, and an outer circumferential surface, the outer ring gear including inner ring gear teeth on the inner circumferential surface, and outer ring gear teeth on the outer circumferential surface;

a first planetary gear having an outer circumferential surface, the first planetary gear outer circumferential surface including first planetary gear teeth;

a second planetary gear having an outer circumferential surface, the second planetary gear outer circumferential surface including second planetary gear teeth;

a sun gear having an outer circumferential surface, the sun gear outer circumferential surface including sun gear teeth;

wherein the first planetary gear teeth mesh with the inner ring gear teeth; wherein the first planetary gear teeth mesh with the second planetary gear teeth; and wherein the second planetary gear teeth mesh with the sun gear teeth;

an output shaft coupleable to the sun gear;

a planetary gear housing bottom having a partially circular inner extension, the housing bottom circular inner extension being slidably fittable into the outer ring gear inner opening, the inner extension including recessed portions; wherein the first planetary gear, the second planetary gear, and the sun gear are slidably fittable into the recessed portions;

a planetary gear housing cover having a handle attachment extension, the planetary gear housing cover being fixably attachable to the planetary gear housing bottom; and a secondary handle pivotably attachable to the planetary gear housing cover handle attachment extension;

wherein the secondary handle is fixably lockable to the main handle via the secondary handle securing mechanism; wherein, when the secondary handle is fixably locked to the main handle, torque applied to the main handle is directly transferred to the output shaft; and wherein the secondary handle is unlockable from the main handle; wherein, when the secondary handle is unlocked from the main handle, torque applied to the main handle is multiplied via the planetary gear mechanism, the multiplied torque being transferred to the output shaft.

2. The wrench of claim 1, wherein the second handle securing mechanism includes a detent.

3. The wrench of claim 2, wherein the second handle includes a biased ball for securing the second handle to the main handle within the detent.

4. The wrench of claim 1, further comprising:

a ratchet directing device having ratchet teeth meshably positionable with the outer ring gear teeth, the ratchet directing device being biasably positionable such that the ratchet teeth allow rotational movement of the outer ring gear only in a single rotational direction relative to the ratchet directing device.

5. The wrench of claim 1, wherein the outer ring gear has a width, and wherein the inner ring gear teeth extend partially the width of the outer ring gear.

6. The wrench of claim 1, wherein the inner ring gear teeth extend the width of the outer ring gear.

7. The wrench of claim 1, wherein the planetary gear housing bottom includes a sun gear pin receiving opening, a first planetary gear pin receiving opening, and a second planetary gear pin receiving opening, the wrench further comprising:

a sun gear pin;

a first planetary gear pin; and a second planetary gear pin.

8. The wrench of claim 7, wherein the sun gear includes an opening for slidably receiving the sun gear pin, the sun gear pin having a first end and a second end, the first end of the sun gear pin being fittable into the sun gear pin receiving opening in the planetary gear housing bottom;

wherein the first planetary gear includes an opening for slidably receiving the first planetary gear pin, the first planetary gear pin having a first end and a second end, the first end of the first planetary gear being fittable into the first planetary gear pin receiving opening in the planetary gear housing bottom; and wherein the second planetary gear includes an opening for slidably fitting the second planetary gear pin, the second planetary gear pin having a first end and a second end, the first end of the second planetary gear being fittable into the second planetary gear pin receiving opening in the planetary gear housing bottom.

9. The wrench of claim 8, wherein the planetary gear housing cover comprises a sun gear pin receiving opening, a first planetary gear pin receiving opening, and a second planetary gear pin receiving opening.

10. The wrench of claim 9, wherein the sun gear pin second end is receivable into the sun gear pin receiving opening of the planetary gear housing cover;

wherein the first planetary gear pin second end is receivable into the first planetary gear pin receiving opening of the planetary gear housing cover; and wherein the second planetary gear pin second ends is receivable into the second planetary gear pin receiving opening of the planetary gear housing cover.

11. The wrench of claim 5, wherein the sun gear further comprises:

a sun gear axis;

a sun gear axial length;

a sun gear first axial end; and a sun gear second axial end;

wherein the sun gear teeth extend radially from the sun gear axis partially along the sun gear axial length from the sun gear first axial end, and wherein a sun gear shaft portion extends along the sun gear axis at the sun gear second axial end;

wherein the first planetary gear further comprises:

a first planetary gear axis;

a first planetary gear axial length;

a first planetary gear first axial end; and a first planetary gear second axial end;

wherein the first planetary gear teeth extend radially about the first planetary gear axis partially along the first planetary gear axial length from the first planetary gear first axial end, and wherein a first planetary gear shaft portion extends along the first planetary gear axis at the first planetary gear second axial end;

and wherein the second planetary gear further comprises:

a second planetary gear axis;

a second planetary gear axial length;

a second planetary gear first axial end; and a second planetary gear second axial end;

wherein the second planetary gear teeth extend radially about the second planetary gear axis partially along the second planetary gear axial length from the second planetary gear first axial end, wherein a second planetary gear shaft portion extends along the second planetary gear axis at the second planetary gear second axial end.

12. The wrench of claim 11, wherein the planetary gear housing cover includes a sun gear shaft opening for receiving the sun gear shaft portion, a fist planetary gear shaft opening for receiving the first planetary gear shaft portion, and a second planetary gear shaft opening for receiving the second planetary gear shaft portion.

13. A variable speed wrench, comprising:

a main handle portion, the main handle portion including a gear housing and a main handle, the main handle including secondary handle securing means;

gear means housed in the main handle portion gear housing;

an output shaft coupled to the gear means;

ratchet means for driving the output shaft in a single radial direction via torque applied to the main handle;

a gear housing bottom having means for securing the gear means; and a gear housing cover having an attached secondary handle, the gear housing cover being fixably attached to the gear housing bottom.

14. The variable speed wrench of claim 13, wherein the gear means includes:

an outer ring gear having a gear width, an inner circumferential surface about an inner opening, and an outer circumferential surface, the outer ring gear including inner gear teeth on the inner circumferential surface, and outer gear teeth on the outer circumferential surface;

a first planetary gear having an outer circumferential surface, the first planetary gear outer circumferential surface including first planetary gear teeth;

a second planetary gear having an outer circumferential surface, the second planetary gear outer circumferential surface including second planetary gear teeth; and a sun gear having an outer circumferential surface, the sun gear outer circumferential surface including sun gear teeth;

wherein the first planetary gear teeth mesh with the inner gear teeth of the outer ring gear inner gear teeth; wherein the first planetary gear teeth mesh with the second planetary gear teeth; and wherein the second planetary gear teeth mesh with the sun gear teeth.

15. A variable speed ratchet wrench comprising:

a main handle portion, the main handle portion including a gear housing and a main handle, the main handle including a secondary handle securing mechanism;

a planetary gear mechanism housed in the main handle portion gear housing;

an output shaft coupled to the planetary gear mechanism;

a ratchet for driving the output shaft in a single rotational direction via torque applied to the main handle;

a planetary gear housing bottom including a lock for securing the planetary gear mechanism; and a planetary gear housing cover having an attached secondary handle, the planetary gear housing cover being fixably attached to the planetary gear housing bottom;

wherein the secondary handle is lockable to the main handle via the secondary handle securing mechanism for direct drives of the output shaft; and wherein the secondary handle securing mechanism is unlockable from the main handle for multiplied speed driving of the output shaft.

16. The variable speed wrench of claim 15, wherein the planetary gear mechanism includes:

an outer ring gear having a gear width, an inner circumferential surface about an inner opening, and an outer circumferential surface, the outer ring gear including inner gear teeth on the inner circumferential surface, and outer gear teeth on the outer circumferential surface;

a first planetary gear having an outer circumferential surface, the first planetary gear outer circumferential surface including first planetary gear teeth;

a second planetary gear having an outer circumferential surface, the second planetary gear outer circumferential surface including second planetary gear teeth; and a sun gear having an outer circumferential surface, the sun gear outer circumferential surface including sun gear teeth;

wherein the first planetary gear teeth mesh with the outer ring gear inner gear teeth; wherein the first planetary gear teeth mesh with the second planetary gear teeth; and wherein the second planetary gear teeth mesh with the sun gear teeth.

* * * * *